US009109847B1

(12) United States Patent
Clinton, III

(10) Patent No.: US 9,109,847 B1
(45) Date of Patent: Aug. 18, 2015

(54) SHOTGUN RELOADING APPARATUS TO ENHANCE SHOOTING EFFICIENCY

(71) Applicant: Paul Eugene Clinton, III, Rosamond, CA (US)

(72) Inventor: Paul Eugene Clinton, III, Rosamond, CA (US)

( * ) Notice: Subject to any disclaimer, the term of this patent is extended or adjusted under 35 U.S.C. 154(b) by 0 days.

(21) Appl. No.: 14/332,298

(22) Filed: Jul. 15, 2014

Related U.S. Application Data

(60) Provisional application No. 61/858,206, filed on Jul. 25, 2013.

(51) Int. Cl.
*F41A 9/01* (2006.01)
*F41C 7/00* (2006.01)

(52) U.S. Cl.
CPC .... *F41A 9/01* (2013.01); *F41C 7/00* (2013.01)

(58) Field of Classification Search
CPC ..... F41A 9/01; F41A 35/00; F41C 7/00; F41C 27/00
USPC ..... 42/2, 106, 90; D22/108; D3/224, 262
See application file for complete search history.

(56) References Cited

U.S. PATENT DOCUMENTS

| | | | | | |
|---|---|---|---|---|---|
| 136,987 | A * | 3/1873 | Gaines | 224/247 |
| 863,798 | A * | 8/1907 | Hodges | 42/87 |
| 946,210 | A * | 1/1910 | Febiger | 42/106 |
| 1,110,209 | A * | 9/1914 | Kirchner | 42/71.01 |
| 2,587,921 | A * | 3/1952 | Suite | 42/71.01 |
| 3,744,170 | A * | 7/1973 | Jensen | 42/87 |
| 4,679,343 | A * | 7/1987 | Gomez | 42/87 |
| D325,952 | S * | 5/1992 | Moore | D22/108 |
| 5,813,157 | A * | 9/1998 | Scott et al. | 42/71.01 |
| D426,612 | S * | 6/2000 | Primeau, IV | D22/110 |
| 6,176,407 | B1 * | 1/2001 | Jones et al. | 224/584 |
| 6,253,481 | B1 * | 7/2001 | Melby | 42/90 |
| 6,698,129 | B1 * | 3/2004 | Hanks | 42/90 |
| 6,726,072 | B2 * | 4/2004 | Rugh | 224/269 |
| 6,817,135 | B1 * | 11/2004 | Jackson | 42/87 |
| D556,449 | S * | 12/2007 | Rogers | D3/262 |
| 8,353,123 | B2 * | 1/2013 | Pullicar et al. | 42/72 |
| 8,479,430 | B1 * | 7/2013 | Masten | 42/85 |
| 8,960,497 | B2 * | 2/2015 | Lefeber | 221/309 |
| 2004/0060220 | A1 * | 4/2004 | Peddie | 42/71.01 |
| 2005/0217470 | A1 * | 10/2005 | Bevacqua | 89/34 |
| 2006/0037227 | A1 * | 2/2006 | Bredeson | 42/90 |
| 2007/0240352 | A1 * | 10/2007 | Pullicar | 42/70.11 |
| 2010/0219217 | A1 * | 9/2010 | Andochick | 224/250 |
| 2012/0285066 | A1 * | 11/2012 | Chvala | 42/90 |
| 2013/0074392 | A1 * | 3/2013 | McCaffery | 42/90 |
| 2014/0190058 | A1 * | 7/2014 | Ballard | 42/90 |

* cited by examiner

*Primary Examiner* — Joshua Freeman
(74) *Attorney, Agent, or Firm* — Plager Schack LLP

(57) ABSTRACT

A shotgun reloading apparatus to conserve user effort and movement in reloading shells in a shotgun to enhance shooting efficiency is provided. The reloading apparatus includes a base member coupled to a side portion of the shotgun, and a storage member coupled to the base member and having a cradle and a plurality of fingers such that space between the cradle and fingers is sufficient to secure a shotgun shell in a first position where a longitudinal axis of the shell is parallel to a longitudinal axis of a breech of the shotgun. This enables a user to rotate the secured shell from the first position to a second position proximate the breech to permit a disposal of the shell into the breech to reload the shotgun.

5 Claims, 4 Drawing Sheets

SHOTGUN RELOADING APPARATUS TO ENHANCE SHOOTING EFFICIENCY

RELATED APPLICATION

The application claims priority to provisional patent application U.S. Ser. No. 61/858,206 filed on Jul. 25, 2013, the entire contents of which is herein incorporated by reference.

BACKGROUND

The embodiments herein relate generally to shotguns and shell reloading devices.

Shotguns are popular firearms used by individuals in a variety of applications such as for hunting birds or other game, sporting activities such as skeet shooting, self-defense, law enforcement and military applications. Shotguns may be preferred over other types of firearms due to their fire power and short-range capabilities. However, shotguns are disadvantageous because they have a low ammunition capacity. In addition, shotguns that use tube magazines are inherently slower to reload between each shot compared to other firearms. This negatively affects the shooting efficiency of the shotgun and can be problematic, especially for users who are injured or unable to use one or both arms.

There exist several shell storage devices that may be attached to the shotgun. These devices allow a user to conveniently store extra shells for reloading the shotgun. However, these devices are limited because the shells are not located near the breech of the shotgun. As a result, the user has to retrieve a shell from the device and expend energy to align the shell in the proper position to dispose in the breech during the reloading process. This reloading process requires significant time and energy by the user and is impractical to users who are injured and/or unable to use one or both arms.

As such, there is a need in the industry for a shotgun reloading apparatus that enhances shooting efficiency and overcomes the limitations of the prior art.

SUMMARY

A shotgun reloading apparatus configured to conserve user effort and movement in reloading shells in a shotgun to enhance shooting efficiency is provided. The reloading apparatus comprises a base member mechanically coupled to a side portion of the shotgun, and a storage member coupled to the base member and comprising a cradle and a plurality of fingers, wherein space between the cradle and fingers is sufficient to secure a shotgun shell in a first position such that a longitudinal axis of the shell is parallel to a longitudinal axis of a breech of the shotgun, thereby enabling a user to rotate the secured shell from the first position within the cradle and fingers to a second position proximate the breech to permit a disposal of the shell into the breech to reload the shotgun.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
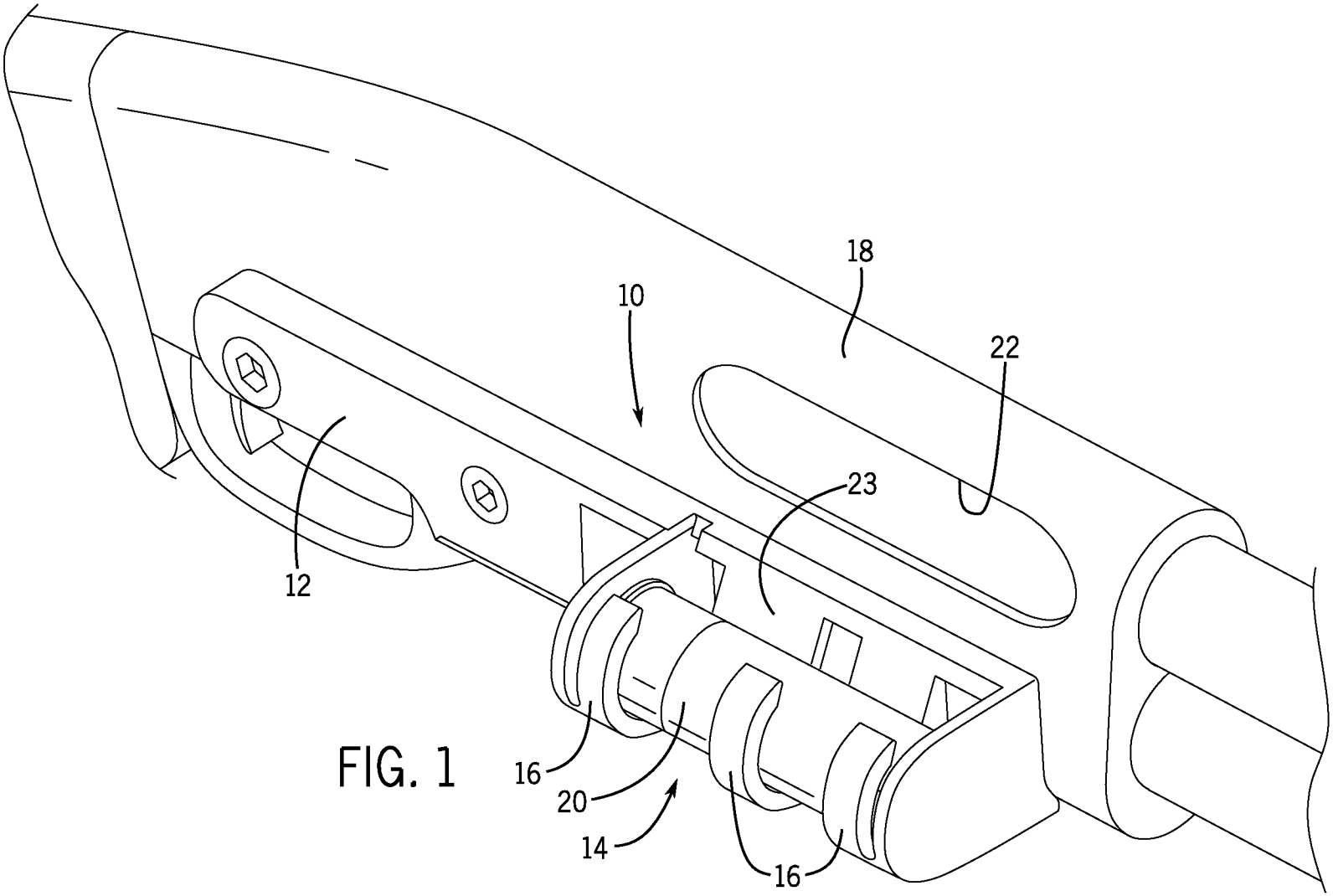
FIG. 1 depicts a perspective view of certain embodiments of the shotgun reloading apparatus shown in use.
Figure 2:
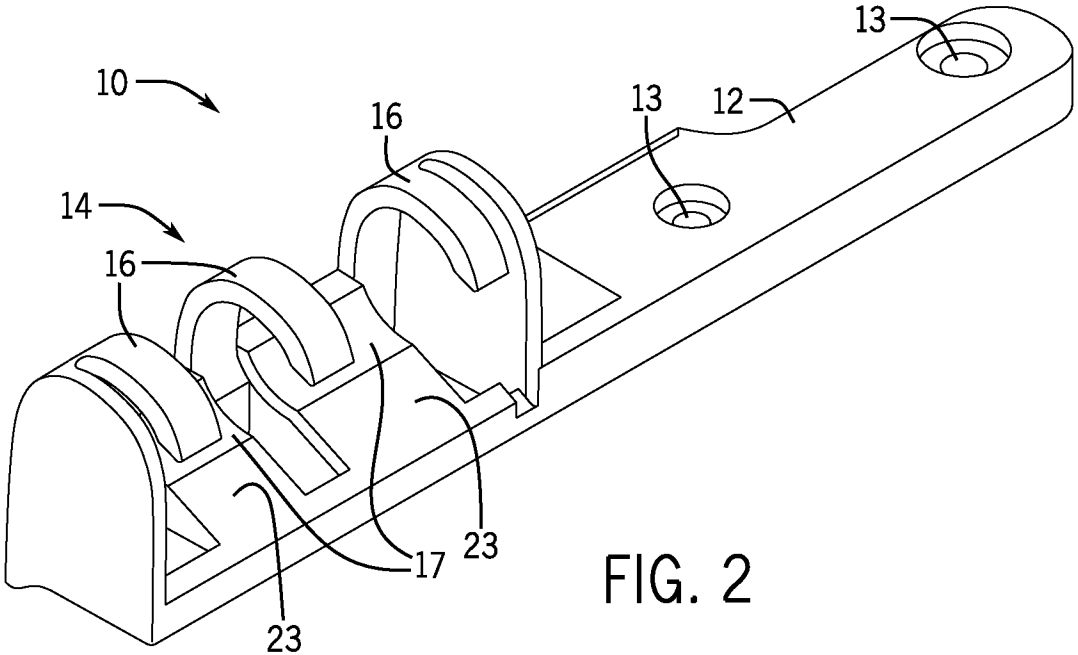
FIG. 2 depicts a perspective view of certain embodiments of the shotgun reloading apparatus.

As depicted in FIGS. 1-2, reloading apparatus 10 is configured to store shell 20, which is used to reload shotgun 18. Reloading apparatus 10 may be used with any type and sized shotgun. However, it shall be appreciated that reloading apparatus 10 may also be used with any alternative type of firearm.

Reloading apparatus 10 comprises base 12 and shell storage member 14 affixed thereon. Base 12 comprises a substantially rectangular face that is configured to fit against a side portion of shotgun 18 below breech 22. Base 12 comprises an outer edge curvature that extends around the trigger portion of shotgun 18. Base 12 comprises mounting holes 13, which are configured to receive fasteners such as screws and nuts (not shown). These fasteners are inserted into mounting holes 13 to secure base 12 to existing apertures on the side receiver portion of shotgun 18.

Shell storage member 14 is affixed to an end of base 12 and comprises fingers 16, cradle 17 and ramp 23. In a preferred embodiment, shell storage member 14 comprises three fingers 16. However, it shall be appreciated that any number of fingers may be used. The outer fingers 16 are attached to end members affixed perpendicularly to the longitudinal axis of base 12. Cradle 17 is positioned adjacent to ramp 23. Cradle 17 and ramp 23 are divided into two portions by a central finger 16. Shell storage member 14 is designed such that shell 20 can be stored in a secured position within fingers 16, cradle 17 and end members. Typically, shell storage member 14 has dimensions to accommodate a single shell 20. However, it shall be appreciated that the dimensions of shell storage member 14 may be altered to accommodate multiple shells at the same time. In a preferred embodiment, the components of reloading apparatus 10 are made from a mixture of nylon and glass. However, it shall be appreciated that any alternative material or combination of materials known in the field may be used instead.

Figure 3:
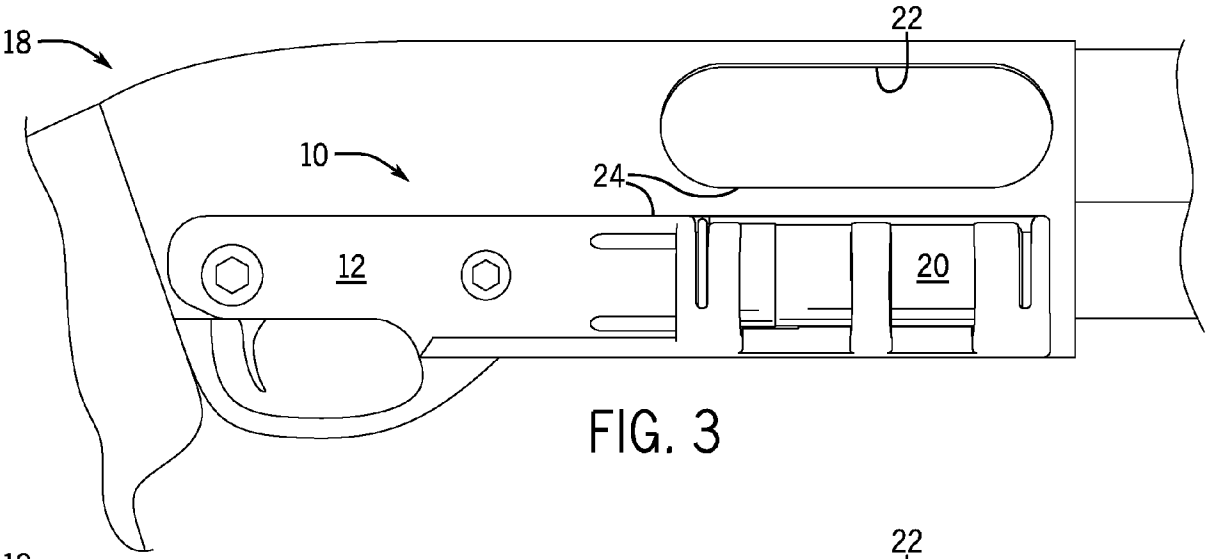
FIG. 3 depicts a side elevation view of certain embodiments of the shotgun reloading apparatus prior to reloading a shotgun with a shell.
Figure 4:
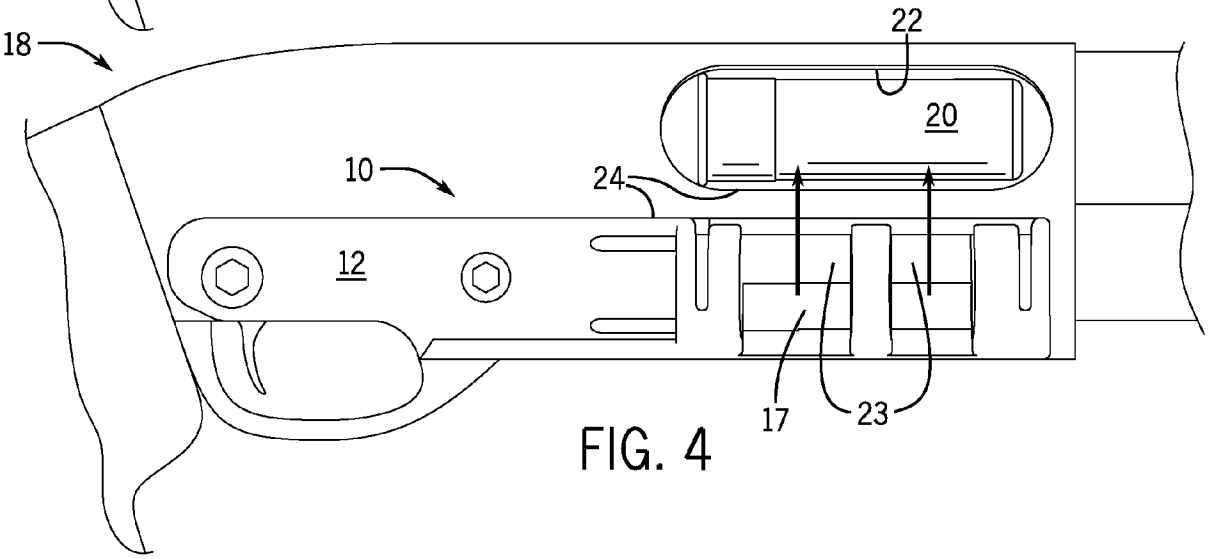
FIG. 4 depicts a side elevation view of certain embodiments of the shotgun reloading apparatus when a shell is reloaded into the shotgun.

As depicted in FIG. 3, reloading apparatus 10 is shown in use prior to reloading shotgun 18. Reloading apparatus 10 is secured to shotgun 18 in position 24 proximate breech 22. Shell 20 is stored in a secured position within fingers 16, cradle 17 and end members of shell storage member 14. In this secured position, shell 20 is positioned such that the longitudinal axis of the shell is parallel to the longitudinal axis of breech 22. Further, shell 20 is positioned directly below breech 22, which allows a user to use minimal effort in reloading shotgun 18. As depicted in FIG. 4, a user reloads shotgun 18 by using her/her hands to apply an upward force on shell 20. This causes shell 20 to rotate from cradle 17 to ramp 23 and into breech 22. Ramp 23 helps the user to guide shell 20 into breech 22. As a result, shooting efficiency is enhanced and user effort and movement is reduced because shell 20 can be quickly transferred from reloading apparatus 10 to breech 22 in one fluid motion by the user.

Figure 5:
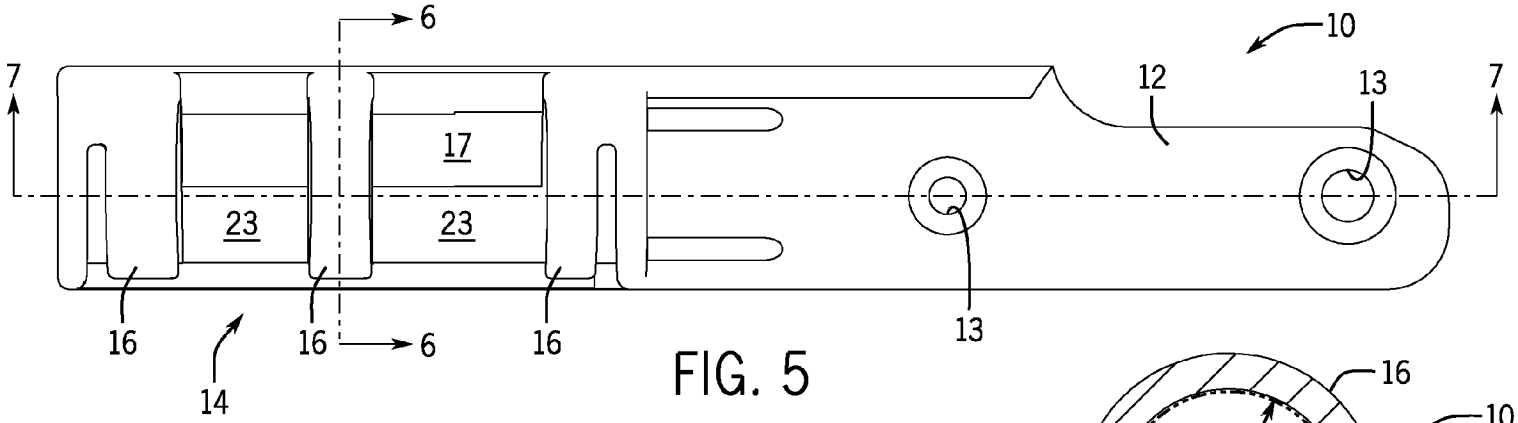
FIG. 5 depicts a top plan view of certain embodiments of the shotgun reloading apparatus.
Figure 6:
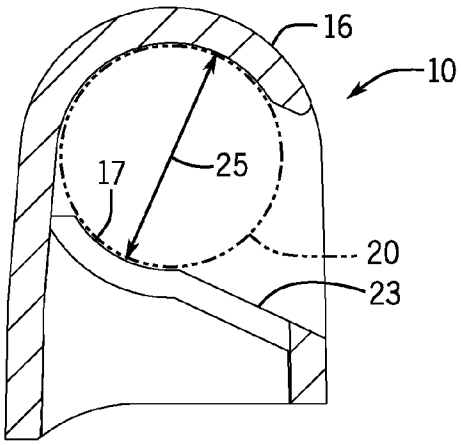
FIG. 6 depicts a cross-sectional view of certain embodiments of the shotgun reloading apparatus taken along line 6-6 in FIG. 5.
Figure 7:
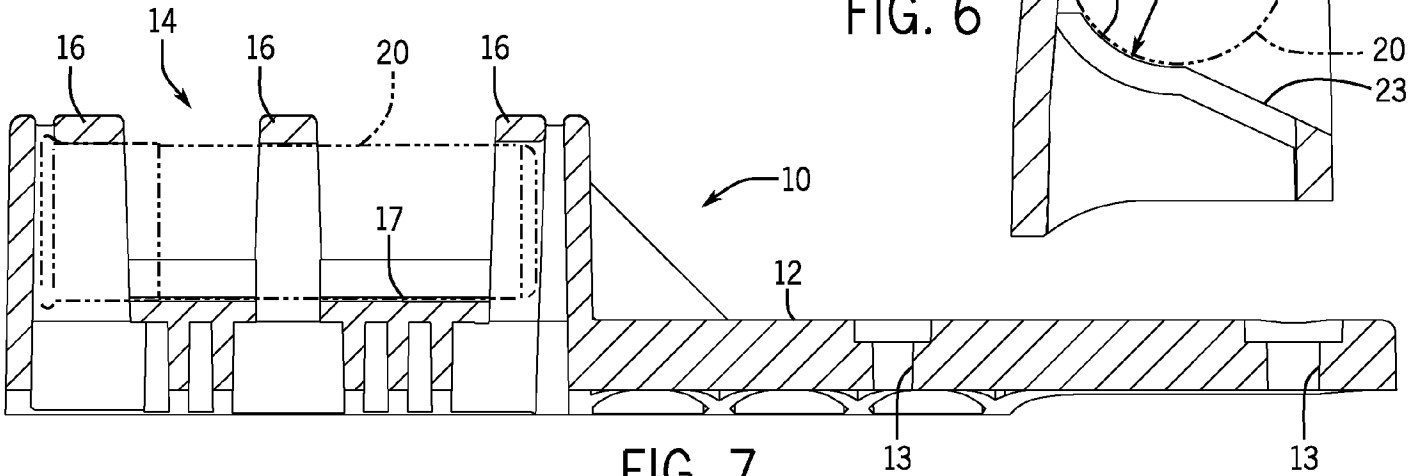
FIG. 7 depicts a cross-sectional view of certain embodiments of the shotgun reloading apparatus taken along line 7-7 in FIG. 5.

FIGS. 5-7 depict additional views of reloading apparatus 10. As depicted in the FIG. 6 cross-sectional view, fingers 16 and cradle 17 have dimensions sufficient to accommodate a particular sized shell 20 with cross-sectional diameter 25. More specifically, cradle 17 comprises a surface with a cross-sectional cradle arc radius equivalent to the cross-sectional radius of shell 20. Similarly, each finger 16 comprises an arc with an arc radius equivalent to the cross-sectional radius of shell 20. This allows shell 20 to fit securely within the space between fingers 16 and cradle 17.

It shall be appreciated that the components of reloading apparatus 10 described in several embodiments herein may comprise any alternative known materials in the field and be of any color, size and/or dimensions. This allows the apparatus to accommodate any variety and size of shotguns or shells. It shall be appreciated that the components of the reloading apparatus described herein may be manufactured and assembled using any known techniques in the field. For example, an injection molding process may be used to fabricate reloading apparatus 10.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A shotgun reloading apparatus configured to conserve user effort and movement in reloading shells in a shotgun to enhance shooting efficiency, the reloading apparatus comprising:

a base member mechanically coupled to a side portion of the shotgun; and a storage member coupled to the base member and comprising a cradle and a plurality of fingers, wherein space between the cradle and fingers is sufficient to secure a shotgun shell in a first position such that a longitudinal axis of the shell is parallel to a longitudinal axis of a breech of the shotgun, thereby enabling a user to rotate the secured shell from the first position within the cradle and fingers to a second position proximate the breech to permit a disposal of the shell into the breech to reload the shotgun, wherein the storage member further comprises a ramp adjacent to the cradle to enable the shell to rotate from the cradle to the ramp.

2. The shotgun reloading apparatus of claim 1, wherein each finger forms an arc comprising a finger arc radius equivalent to a cross-sectional radius of the shell.

3. The shotgun reloading apparatus of claim 2, wherein the cradle comprises a surface configured to be in contact with the shell and comprising a cross-sectional cradle arc radius equivalent to the cross-sectional radius of the shell.

4. The shotgun reloading apparatus of claim 3, wherein the cradle and ramp comprise a first cradle portion adjacent to a first ramp portion and a second cradle portion adjacent to a second ramp portion.

5. The shotgun reloading apparatus of claim 3, further comprising a first end member affixed to the storage member and a second end member affixed to the storage member, wherein the shell in the first position is secured within the first end member, second end member, cradle and plurality of fingers.

* * * * *